US006283167B1

(12) United States Patent
Chang et al.

(10) Patent No.: US 6,283,167 B1
(45) Date of Patent: Sep. 4, 2001

(54) WEBBING WITH SIMULATED STITCHING

(75) Inventors: Jae Chul Chang; Eun Seong Chang, both of Lake Forest, IL (US)

(73) Assignee: Ribbon Webbing Corporation, Chicago, IL (US)

( * ) Notice: Subject to any disclaimer, the term of this patent is extended or adjusted under 35 U.S.C. 154(b) by 0 days.

(21) Appl. No.: 09/688,515

(22) Filed: Oct. 16, 2000

(51) Int. Cl.[7] ..... D03D 11/00; B32B 23/02; B60R 21/00

(52) U.S. Cl. ..... 139/383 R

(58) Field of Search ..... 139/383 R

(56) References Cited

U.S. PATENT DOCUMENTS 3,926,227 * 12/1975 Takada et al. ..... 139/383 R
4,421,352 * 12/1983 Raue et al. ..... 294/74
4,800,929 * 1/1989 Watanabe ..... 139/383 R
5,436,044 * 7/1995 Pinkos ..... 428/36.1

FOREIGN PATENT DOCUMENTS

WO 92/03603 * 8/1991 (WO) .

* cited by examiner

*Primary Examiner*—Andy Falik
(74) *Attorney, Agent, or Firm*—Marshall, O'Toole, Gerstein, Murray & Borun

(57) ABSTRACT

A woven belt and method for weaving a belt are disclosed. The belt includes a woven outer webbing defining a length, the outer webbing having a top layer and a bottom. A plurality of binder yarns are woven into the outer webbing to secure together the top and bottom layers. The binder yarns are aligned substantially parallel to one another and to the length. A plurality of stuffer yarns extend through the top and bottom layers of the outer webbing and between the binder yarns. A plurality of simulated chain stitch yarns are woven into the outer webbing, the simulated chain stich yarns being aligned substantially parallel to one another and to the length.

19 Claims, 2 Drawing Sheets

WEBBING WITH SIMULATED STITCHING

FIELD OF THE INVENTION

The invention relates generally to webbing and, more specifically, to webbing belts with simulated stitching and to techniques for making webbing belts with simulated stitching using an automatic loom.

DESCRIPTION OF THE RELATED ART

Many conventional fabric belts are made using a multilayer construction that includes a core material which is encased by a separate fabric shell. Typically, the fabric shell is selected to provide a desired outward appearance such as a texture and/or an aesthetically appealing pattern. Additionally, the fabric shell may be selected to provide desired surface durability characteristics such as abrasion resistance, tear resistance, color fastness, etc. The core material, on the other hand, is typically selected to provide a desired shape, body, stiffness, weight, etc. to the fabric shell to suit a particular application. While the core material and the fabric shell may be individually selected to achieve the above-noted aesthetic qualities and other surface and/or feel qualities, it is the combination of the core material and the fabric shell and the interaction between the core material and the shell material which determines the overall characteristics of the completed belt.

Fabrication of the above-described conventional belts typically involves wrapping the fabric shell material around lengths of the core material. The core material is typically pre-cut to a width, which is approximately the desired width of the completed belt. The fabric shell is then cut to a width that is somewhat greater than twice the width of the core material so that the fabric shell material can be wrapped around the core material and so that the cut edges of the fabric shell can be folded under and lapped together to form final exposed edges along the length of the belt that will resist fraying. Typically, multiple rows of longitudinal chain stitching is used to bind the cut edges of the fabric shell together and to firmly bind the core material to the fabric shell.

One particularly popular fabric belt that is made using the above-described conventional techniques is commonly referred to as a karate belt. Karate belts use a synthetic polypropylene webbing as a core material and use a separate fabric shell which may be made of a woven cotton material or any other material which provides a canvas like feel. As is widely known, karate belts are fabricated using the above described process of attaching a separate fabric shell to the webbing core. Traditionally, karate belts include several rows of chain stitching that run along the length of the belt and are made to be tied or knotted many times over and washed as any other item of apparel. The chain stitching is visible on both surfaces of the belt, and creates an appearance which is generally accepted and expected by the karate belt-buying public.

While conventional karate belts have been used for some time, such conventional belts have several disadvantages. First, conventional karate belts are relatively expensive to manufacture because the core material and the fabric shell are sewn together by manually feeding the core and the shell into a sewing machine. This manual sewing process results in high labor costs per unit and necessarily introduces a relatively high variability in the quality of the finished product due to variability in workmanship, defects, etc. Further, the chain stitching used to bind the shell to the core is exposed on the surface of the belt and can easily become snagged or worm. When even a portion of a chain stitch fails, the entire row of chain stitching can be easily pulled out, which allows the fabric shell and the core to become separated along that row of stitching. Still further, the exposed edges formed by the lapped edges of the fabric shell are susceptible to being caught or snagged and pulled apart. Thus, conventional karate belts are relatively expensive to manufacture and may be susceptible to failure (i.e., separation of the core and the casing) because the stitching which binds the casing and the core together is exposed on the surface of the belt.

SUMMARY OF THE INVENTION

A webbing with simulated chain stitching and a method of operating an automatic loom to produce webbing with simulated chain stitching is provided to provide a lower cost, higher durability fabric belt, which may be used as an improved karate belt or more generally as a low cost, high quality webbing for backpacks, cargo straps, apparel, etc. Generally speaking, the webbing with simulated stitching and method of making the same reduces manufacturing costs by eliminating the need to manually sew a core and casing. In addition, the webbing is more durable since the simulated chain stitching is more difficult to pull out.

In accordance with certain aspects of the present invention, a woven belt is provided comprising a woven outer webbing defining a length, the outer webbing having a top layer and a bottom. A plurality of binder yarns are woven into the outer webbing to secure together the top and bottom layers, the binder yarns aligned substantially parallel to one another and to the length. A plurality of stuffer yarns extend through the top and bottom layers of the outer webbing and between adjacent binder yarns. A plurality of simulated chain stitch yarns are woven into the outer webbing, the simulated chain stitch yarns being aligned substantially parallel to one another and to the length.

In accordance with additional aspects of the present invention, a method for weaving a belt is provided comprising weaving an outer webbing having top and bottom layers, the outer webbing defining a length. Weaving a plurality of binder yarns into the outer webbing to secure the top layer to the bottom, the binder yarns being aligned substantially parallel to one another and to the length to define a plurality of longitudinal pockets between the top layer, bottom layer, and adjacent binder yarns. Inserting stuffer yarns into the plurality of longitudinal pockets, and weaving a simulated chain stitch yarn into outer webbing.

Other features and advantages are inherent in the apparatus claimed and disclosed or will become apparent to those skilled in the art from the following detailed description and its accompanying drawings.

DETAILED DESCRIPTION OF THE PREFERRED EMBODIMENTS

While a webbing and a technique for making a webbing with simulated chain stitching are described in conjunction with emulating the look of a traditional karate belt, it should be noted that the webbing and the techniques for making the webbing described herein can be advantageously used to provide a high quality webbing material for use in a variety of applications, including, for example, backpacks, outdoor apparel, climbing equipment, cargo straps, or more generally, any application that requires the look and feel of a fabric belt with the strength and durability of a webbing material.

Figure 1:
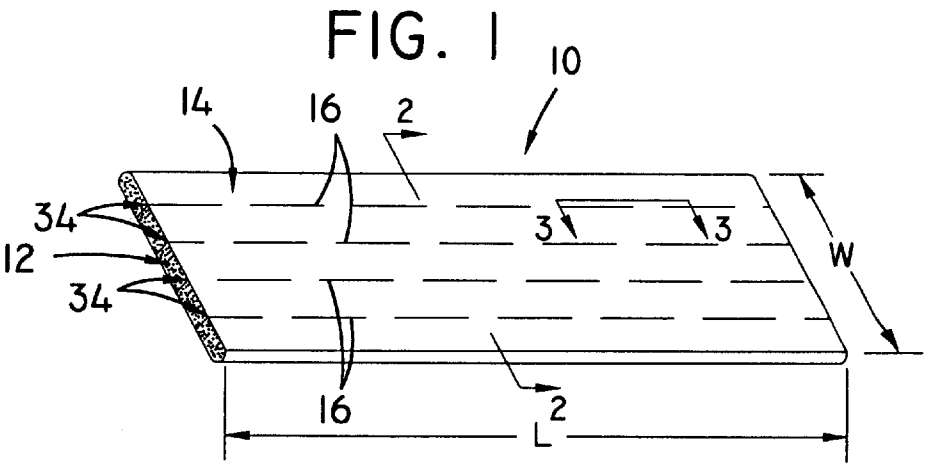
FIG. 1 is a perspective view of a strip of woven webbing material constructed in accordance with the teachings of the present invention.

With reference to FIG. 1, a length of a woven belt constructed in accordance with the teachings of the present invention is generally indicated with reference numeral 10. The woven belt 10 generally includes a core 12 surrounded by a woven outer webbing 14. The belt 10 has a width "W" and a length "L". A plurality of yarns simulating a chain stitch 16 are woven into the outer webbing 14 so that they are substantially parallel to one another and extend along the length L of the belt 10.

Figure 2:
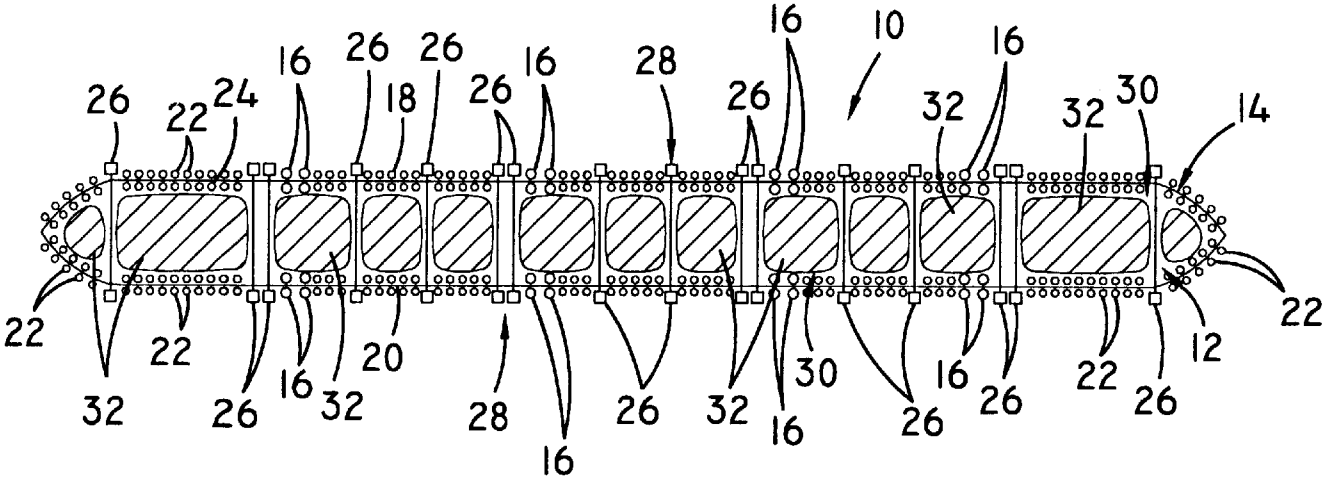
FIG. 2 is a cross-sectional view taken along line 2—2 of the woven webbing of FIG. 1.

As shown in greater detail in FIG. 2, the woven outer webbing 14 includes a top layer 18 and a bottom layer 20. The top and bottom layers 18, 20 are formed of outer warp yarns 22 woven with several picks of a weft yarn 24. While various weave patterns may be used, a basic 1×1 plain weave is suitable for the woven outer webbing 14. In a preferred embodiment, the top and bottom layers 18, 20 are formed simultaneously so that the woven outer webbing 14 is formed with a tubular shape.

Figure 3:
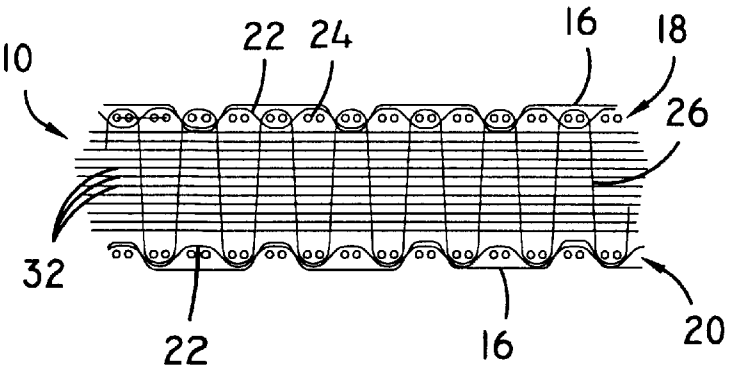
FIG. 3 is across-sectional view taken alongline 3—3 of the woven webbing of FIG. 1.

A plurality of binder yarns 26 are provided for securing together the top and bottom layers 18, 20. With reference to FIGS. 1 and 3, the binder yarns 26 extend along the length L of the belt 10, generally parallel to the simulated chain stitch yarns 16. The binder yarns 26 are spaced along the width W of the belt 10 to secure the top and bottom layers 18, 20 at several points along the width W. As best shown in FIG. 3, each binder yarn 26 preferably passes over a pair of weft yarn 24 picks located at the top layer 18 of the belt 10, extends through the belt 10, and passes over a pair of weft yarns 24 picks located at the bottom layer 20 of the belt 10. This 2×2 pattern may be repeated along the entire length L of the belt 10. Each row 28 of binder material may comprise one or more individual binder yarns 26, as best illustrated in FIG. 2, which shows rows 28 of both single and double binder yarns 26. In addition to securing together the top and bottom layers 18, 20, the binder yarns 26 further define longitudinal pockets 30 between the top layer 18, bottom layer 20, and adjacent binder rows 28. The pockets 30 also extend along the length L of the belt 10.

A plurality of stuffer yarns 32 are provided for forming the core 12 of the belt 10. As best shown in FIG. 2, the stuffer yarns 32 are positioned inside the longitudinal pockets 30 described above. In the illustrated embodiment, the stuffer yarns are not woven, but instead are simply retained inside the longitudinal pockets 30. The stuffer yarns 32 are preferably pulled through the loom as the outer webbing 14 is formed, so that the outer webbing 14 is woven about the stuffer yarns 32. As noted above, the stuffer yarns 32 create the core 12 of the belt 10 and therefore are primarily responsible for the thickness, weight, and flexibility of the belt 10. The stuffer yarns 32 may be provided as a lesser number of relatively thick yarns, or a greater number of relatively thin yarns. The size and amount of the stuffer yarns 32 may be adjusted according to the size of the longitudinal pocket 30.

The simulated chain stitch yarns 16 are also woven into the outer webbing 14. As best shown in FIG. 1, a plurality of chain stitch rows 34 are spaced along the width W of the belt 10 and woven into both the top and bottom layers 18, 20 of the outer webbing 14. According the illustrated embodiment, each chain stitch row 34 includes a pair of simulated chain stitch yarns 16. It will be appreciated, however, that a single yarn or more than three yarns may be used to form each chain stitch row 34. The simulated chain stitch yarns 16 are preferably woven into the outer webbing 14 in a repeating 2×6 pattern, in which the simulated chain stitch yarns 16 pass under a pair of weft yarn 24 picks and over the next six weft yarn 24 picks. It will be appreciated, however, that other patterns may be used.

A wide variety of materials may be used for the simulated chain stitch yarns 16, outer warp yarns 22, weft yarns 24, binder yarns 26, and stuffer yarns 32. Suitable materials include, but are not limited to, spun polyester, cotton, TC yarn (a polyester/cotton blend), polypropylene and all olefin types, polyester, nylon, acrylic, acetate, polyethylene, rayon, modacrylic, spandex, aramid, silk, and all combination hybrids of the above materials. In addition, the linear density or denier of the yarns used in the belt 10 may vary, and are preferably within the range of 6 to 30 Ne as measured on the cotton count scale. In particular, it may be preferable to use a more dense (and therefore thicker) yarn for the simulated chain stitch yarns 16 than for the outer warp yarns 22 so that the simulated chain stitch is more visible. The thickness of each yarn is preferably 0.050 to 0.300 inches.

It will further be appreciated that variety of belt widths may be provided. Typically, the belt width W will be on the order of one to three inches, however smaller or larger belts may be woven. The width of the belt relies primarily on the number of warp ends used. For a width of one inch, the belt preferably uses approximately 100 to 150 outer warp yarns 22, approximately 5 to 20 binder yarns 26, and approximately 5 to 25 simulated chain stitch yarns 16. For the materials and densities noted above, an average of approximately 40 to 46 weft picks are used per each inch of belt length.

Figure 4:
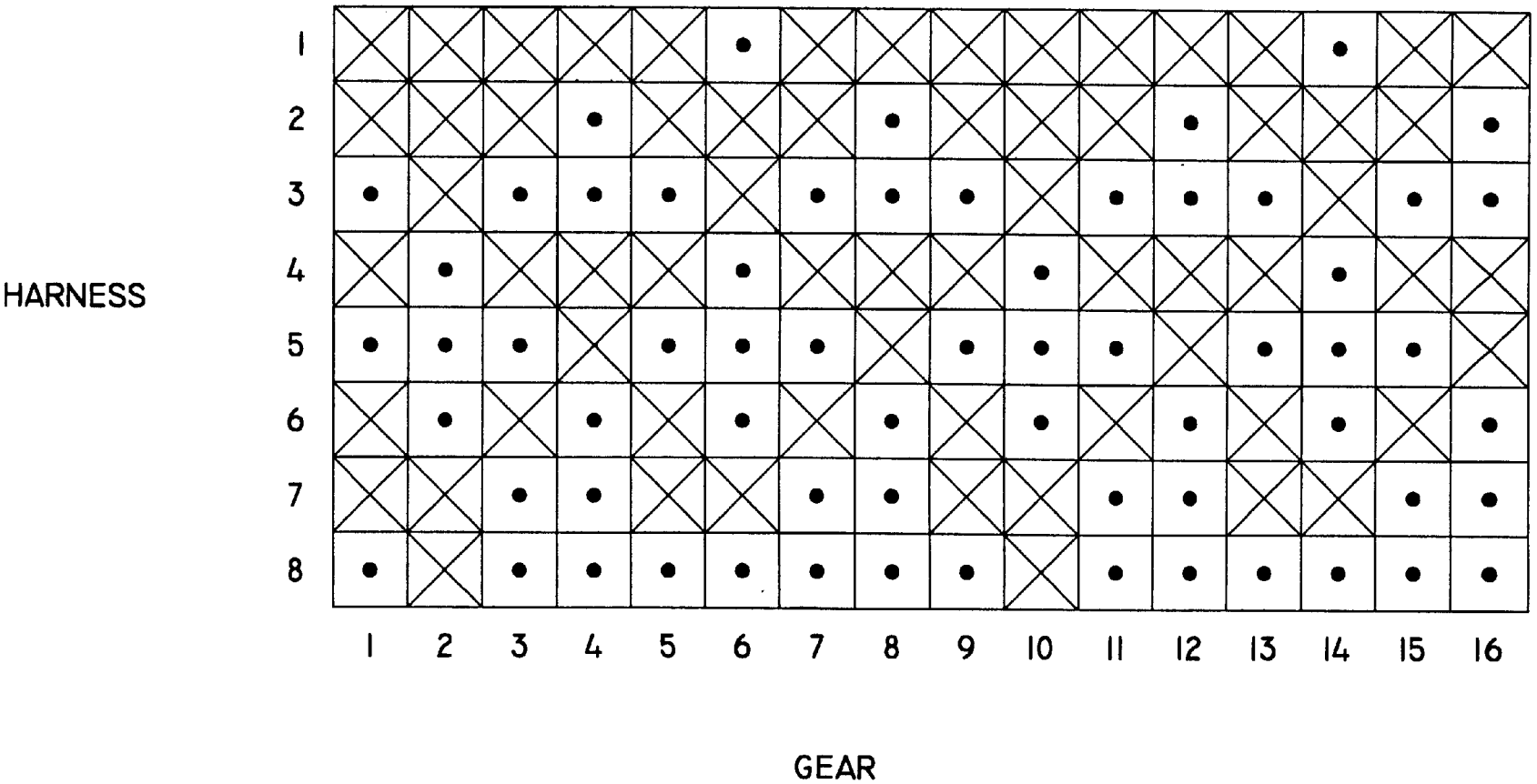
FIG. 4 is a diagram of the chain draft for the weave used in the woven webbing of FIG. 1.

According to additional aspects of the present invention, a method for weaving a belt having a simulated chain stitch is also provided. The method may be performed by programming the gears of a conventional loom according to the chain draft depicted in FIG. 4, wherein the gears are shown on the horizontal axis and the harnesses are shown on the vertical axis. FIG. 4 depicts harnesses for only a portion of the belt width W, and an "X" indicates an up pick while a "•" indicates an down pick. Harness one is for the top chain stitch 16, harnesses two through five are for the top and bottom layers 18, 20, harness six is for the stuffer yarns 32, harness seven is for the binder yarns, and harness eight is for the bottom chain stitch 16.

In accordance with the method, the outer webbing 14 is woven to form the top and bottom layers 18, 20 with an overall length L. The plurality of binder yarns 26 are simultaneously woven into the outer webbing 14 to secure the top layer 18 to the bottom layer 20. The binder yarns 26 are aligned substantially parallel to one another and to the length L of the belt, to define the plurality of longitudinal pockets 30. Stuffer yarns 32 are provided about which the outer webbing 14 is woven so that the stuffer yarns 32 are enclosed by the plurality of longitudinal pockets 30. The simulated chain stitch yarns 16 are simultaneously woven into the outer webbing 14 to provide the appearance of a conventional chain stitch.

While the invention has been described with reference to specific examples, which are intended to be illustrative only and not to be limiting of the invention, it will be apparent to those of ordinary skill in the art that changes, additions or deletions maybe made to the disclosed embodiments without departing from the spirit and the scope of the invention.

What is claimed is:

1. A woven belt comprising:

a woven outer webbing defining a length, the outer webbing having a top layer and a bottom layer;

a plurality of binder yarns woven into the outer webbing and securing together the top and bottom layers, the binder yarns aligned substantially parallel to one another and to the length;

a plurality of stuffer yarns extending through the top and bottom layers of the outer webbing and between adjacent binder yarns; and at least one simulated chain stitch yarn woven into the outer webbing, the simulated chain stitch yarn passing through only one of the top and bottom layers of the outer webbing.

2. The woven belt of claim 1, in which the outer webbing comprises a one by one plain weave.

3. The woven belt of claim 1, in which the at least one simulated chain stitch yarn comprises a two by six pattern.

4. The woven belt of claim 1, in which the outer webbing comprises a woven tube.

5. The woven belt of claim 1, in which the stuffer yarns comprise TC yarns.

6. The woven belt of claim 1, in which the woven outer webbing comprises outer warp yarns having a linear density of approximately 6 to 30 Ne cotton count.

7. The woven belt of claim 6, in which the at least one simulated chain stitch yarn has a linear density greater than that of the outer warp yarns.

8. The woven belt of claim 1, in which a plurality of simulated chain stitch yarns are woven into both the top and bottom layers of the outer webbing.

9. The woven belt of claim 8, in which each of the plurality of simulated chain stitch yarns is spaced along a width of the outer webbing.

10. The woven belt of claim 9, which each of the plurality of simulated chain stitch yarns is aligned substantially parallel to one another and to the length of the outer webbing to provide the appearance of a karate belt.

11. A method of weaving a belt comprising:

weaving an outer webbing having top and bottom layers, the outer webbing defining a length;

weaving a plurality of binder yarns into the outer webbing to secure the top layer to the bottom layer, the binder yarns being aligned substantially parallel to one another and to the length to define a plurality of longitudinal pockets between the top layer, bottom layer, and adjacent binder yarns;

inserting stuffer yarns into the plurality of longitudinal pockets; and weaving a simulated chain stitch yarn into the outer webbing, wherein the simulated chain stitch yarn passes through only one of the top and bottom layers of the outer webbing.

12. The method of claim 11, in which the simulated chain stitch yarn parallel to the length of the outer webbing.

13. The method of claim 11, in which a plurality of simulated chain stitch yarns is woven into the top and bottom layers of the outer webbing.

14. The method of claim 11, in which the outer webbing is woven with a one by one plain weave pattern.

15. The method of claim 11, in which the simulated chain stitch yarn is woven with a repeating two by six pattern.

16. A length of webbing, comprising:

top and bottom outer webbing layers;

a plurality of binder yarns securing together the top and bottom outer webbing layers;

a plurality of stuffer yarns extending between the top and bottom outer webbing layers;

at least one simulated chain stitch yarnwoven into one of the top and bottom outer webbing layers.

17. The webbing of claim 16, in which a plurality of simulated chain stitch yarns is woven into the top and bottom outer webbing layers, wherein each simulated chain stitch yarn passes through only one of the top and bottom webbing layers.

18. The webbing of claim 17, in which the plurality of simulated chain stitch yarns is spaced along a width of the webbing, each of the plurality of simulated chain stitch yarns being aligned substantially parallel to one another and to the length of the webbing.

19. The webbing of claim 18, in which the woven outer webbing comprises outer warp yarns having a linear density, and in which each simulated chain stitch yarn has a linear density greater than that of the outer warp yarns.

* * * * *

UNITED STATES PATENT AND TRADEMARK OFFICE

CERTIFICATE OF CORRECTION

PATENT NO. : 6,283,167 B1
DATED : September 4, 2001
INVENTOR(S) : Chang et al.

It is certified that error appears in the above-identified patent and that said Letters Patent is hereby corrected as shown below:

Column 5,
Line 40, after "claim 9," should be added -- in --.

Column 6,
Line 14, after "yarn" should be added -- is --.
Line 28, "yarnwoven" should be -- yarn woven --.

Signed and Sealed this

Twenty-eighth Day of May, 2002

*Attest:*

*Attesting Officer*

JAMES E. ROGAN
*Director of the United States Patent and Trademark Office*